US006453955B1

(12) United States Patent
Lee

(10) Patent No.: US 6,453,955 B1
(45) Date of Patent: Sep. 24, 2002

(54) LIQUID DISPENSING SYSTEM

(76) Inventor: Jonathan D. Lee, 2693 Turnball Canyon Rd., Hacienda Heights, CA (US) 91745

( * ) Notice: Subject to any disclaimer, the term of this patent is extended or adjusted under 35 U.S.C. 154(b) by 0 days.

(21) Appl. No.: 09/800,165

(22) Filed: Mar. 6, 2001

(51) Int. Cl.[7] ..... B67D 5/08
(52) U.S. Cl. ..... 141/198; 222/66; 222/67
(58) Field of Search ..... 222/66, 67, 131, 222/183, 146.1, 325; 141/198

(56) References Cited

U.S. PATENT DOCUMENTS 3,408,053 A * 10/1968 Vantroba ..... 222/67
3,721,369 A * 3/1973 Conti et al. ..... 222/67
5,111,966 A * 5/1992 Fridman ..... 222/67
5,833,096 A 11/1998 Ohu ..... 222/146
5,901,880 A * 5/1999 Clarke ..... 222/66
6,076,546 A * 7/2000 Waters ..... 141/198
6,273,295 B1 * 8/2001 Quartarone et al. ..... 222/67

* cited by examiner

*Primary Examiner*—Philippe Derakshani
(74) *Attorney, Agent, or Firm*—Arter & Hadden LLP

(57) ABSTRACT

A liquid dispensing system is disclosed in which a reservoir assembly is provided for receiving a liquid flow from a liquid supply. A liquid level sensor is provided for initiating the liquid flow until a predetermined liquid level is established in the reservoir assembly. A liquid flow sensor indicates a flow condition from the liquid supply to the reservoir assembly. A dispensing member such as a faucet is provided for dispensing liquid from the reservoir. The reservoir assembly of the present liquid dispensing system includes an overflow protector assembly for preventing an overflow condition of liquid from the reservoir assembly.

25 Claims, 8 Drawing Sheets

LIQUID DISPENSING SYSTEM

BACKGROUND OF THE INVENTION

The present invention is directed to the field of liquid dispensing units, particularly water coolers of the type for dispensing water in offices and other public places. A familiar type of water cooler is the common "top-loading" cooler in which a five-gallon water bottle sits atop a dispensing unit. The open end of the water bottle points downwardly to allow "gravity-fed" water dispensing.

There are several difficulties and drawbacks associated with this traditional design. A fall five-gallon water bottle weighs about 45 lbs., and can be bulky and awkward to lift. This can result in back strain for service personnel. Also, since the open end of the bottle must be pointed downwardly during installation, the installation operation must be done quickly and efficiently to avoid spilling. However, spilling and the resulting mess is nevertheless a common occurrence, resulting in waste and a potential safety hazard. Further, a top-loading cooler is "top heavy." Such a cooler may occasionally overturn, resulting in a large mess and potential injury for persons standing nearby.

The soft drink dispensing industry has previously adopted boxed liquids in attempt to more efficiently dispense with their liquids. Boxed contents maintain certain advantages over traditional, canister-based delivery systems. Boxes are more space efficient, low cost, and stackable. However, the different applications and design constraints associated with water delivery render conventional soft drink dispenser technology inappropriate.

Unlike soft drinks, water dispensers frequently employ both hot and warm water dispensers, requiring the water to be simultaneously available in heated and chilled formats. Soft drink machines can have direct feeds of tap water, or soda water, that is typically mixed with syrup dispensed in a box. Thus, level indicators are not as critical, nor does the contents of the box have to be pre-heated or pre-cooled.

While more conventional water dispensers have implemented volume indicators or low-level water conditions, these earlier solutions are not readily adaptable to a disposable, box-based system, given the opening size and orientation of box effluent structures. The particulars of box design also make it difficult to monitor water depth with a device that is largely non-contaminating.

SUMMARY OF THE INVENTION

In view of the difficulties and drawbacks associated with the previous devices, there is therefore a need for a water dispensing system that allows ease of installation.

There is also a need for a water dispensing system that reduces waste and potential safety hazards.

There is also a need for a water dispensing system that is compatible with a plurality of water supply types.

There is also a need for a water dispensing system that includes an indicator of remaining water volume or an indicator as to a low-level water condition.

These needs and others are satisfied by the liquid dispensing system of the present invention in which a reservoir assembly is provided for receiving a liquid flow from a liquid supply. A liquid level sensor is provided for initiating the liquid flow until a predetermined liquid level is established in the reservoir assembly. A liquid flow sensor indicates a flow condition from the liquid supply to the reservoir assembly. A dispensing member such as a faucet is provided for dispensing liquid from the reservoir. The reservoir assembly of the present liquid dispensing system includes an overflow protector assembly for preventing an overflow condition of liquid from the reservoir assembly.

As will be realized, the invention is capable of other and different embodiments and its several details are capable of modifications in various respects, all without departing from the invention. Accordingly, the drawing and description are to be regarded as illustrative and not restrictive.

DETAILED DESCRIPTION OF THE INVENTION

Figure 1:
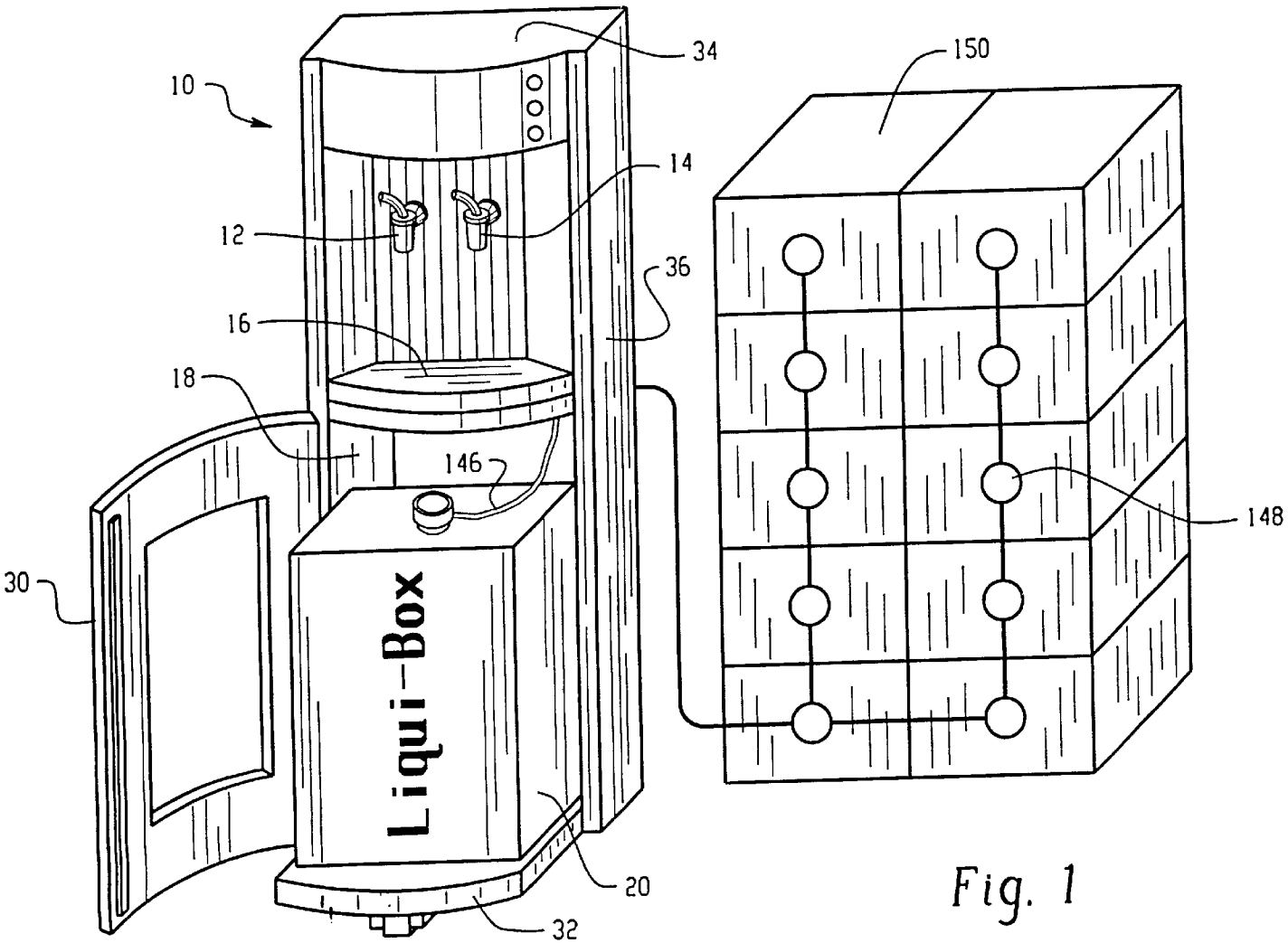
FIG. 1 depicts the general configuration of a first embodiment of the present invention.

The drawing figures are now referenced, where like reference numerals correspond to like elements. FIG. 1 shows the general configuration of a preferred embodiment of the present liquid dispensing system. The system includes a cabinet 10 for enclosing and retaining the system components. The cabinet 10 includes one or more dispensing members, such as faucets 12, 14, for dispensing liquid. A drain 16 is provided for catching any liquid splashed or dripped from the faucets 12, 14. A lower cabinet section 18 is provided for retaining a liquid supply 20, preferably a removable water container.

Figure 2:
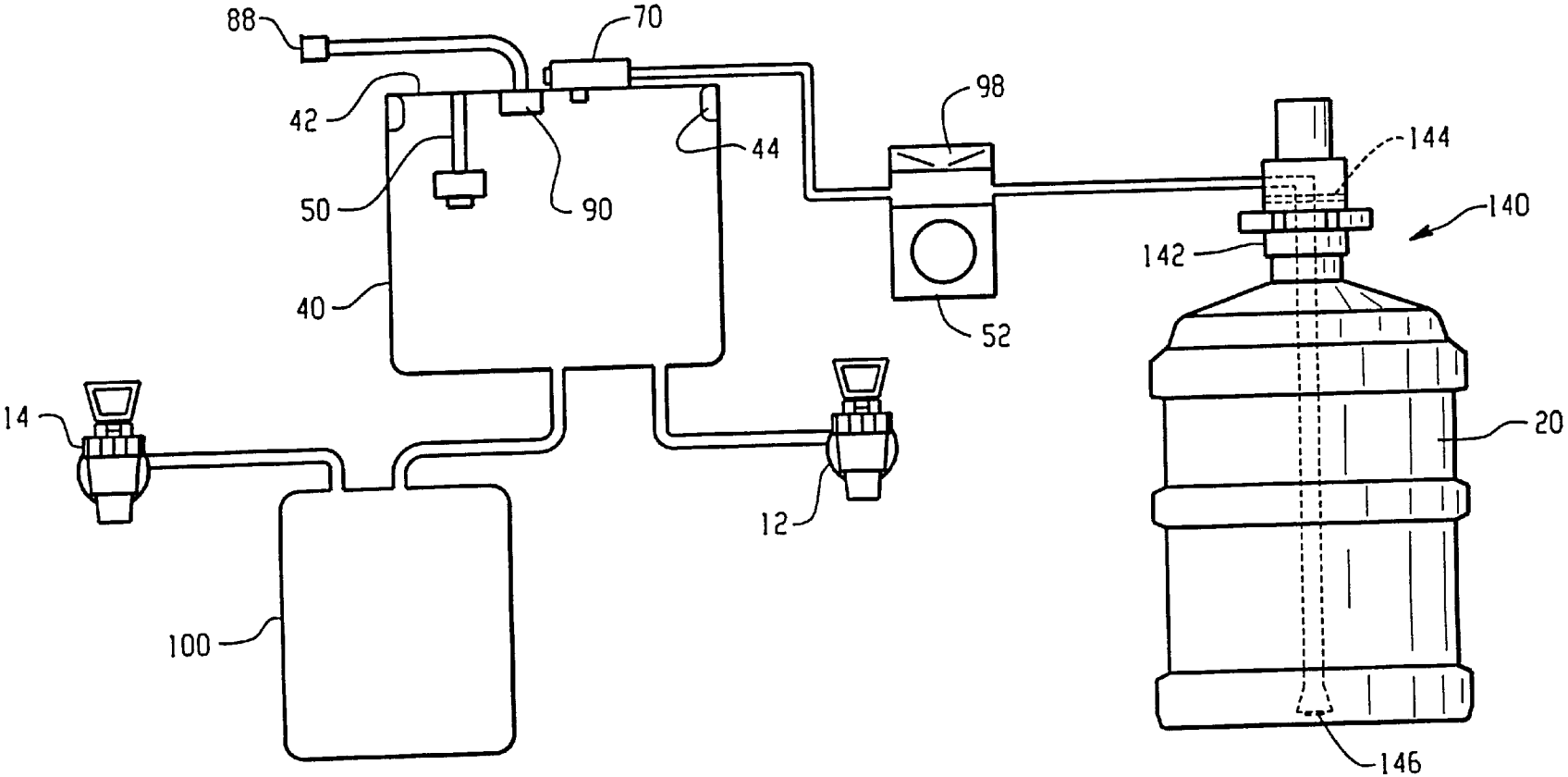
FIG. 2 is a schematic view showing the operational components according to the present invention.
Figure 3A:
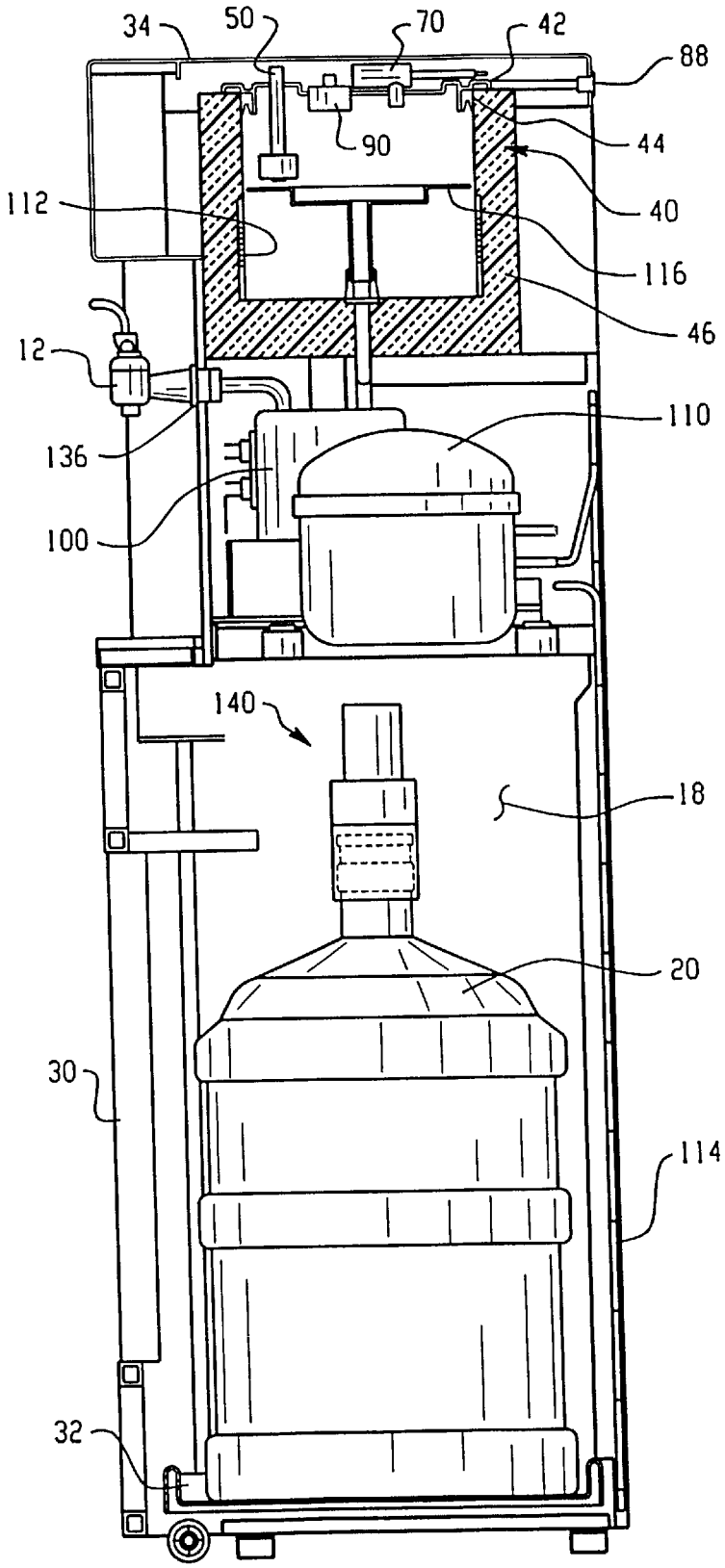
FIGS. 3A, 3B and 3C are sectional views respectively showing side, rear and front sectional views of the present assembly.
Figure 3B:
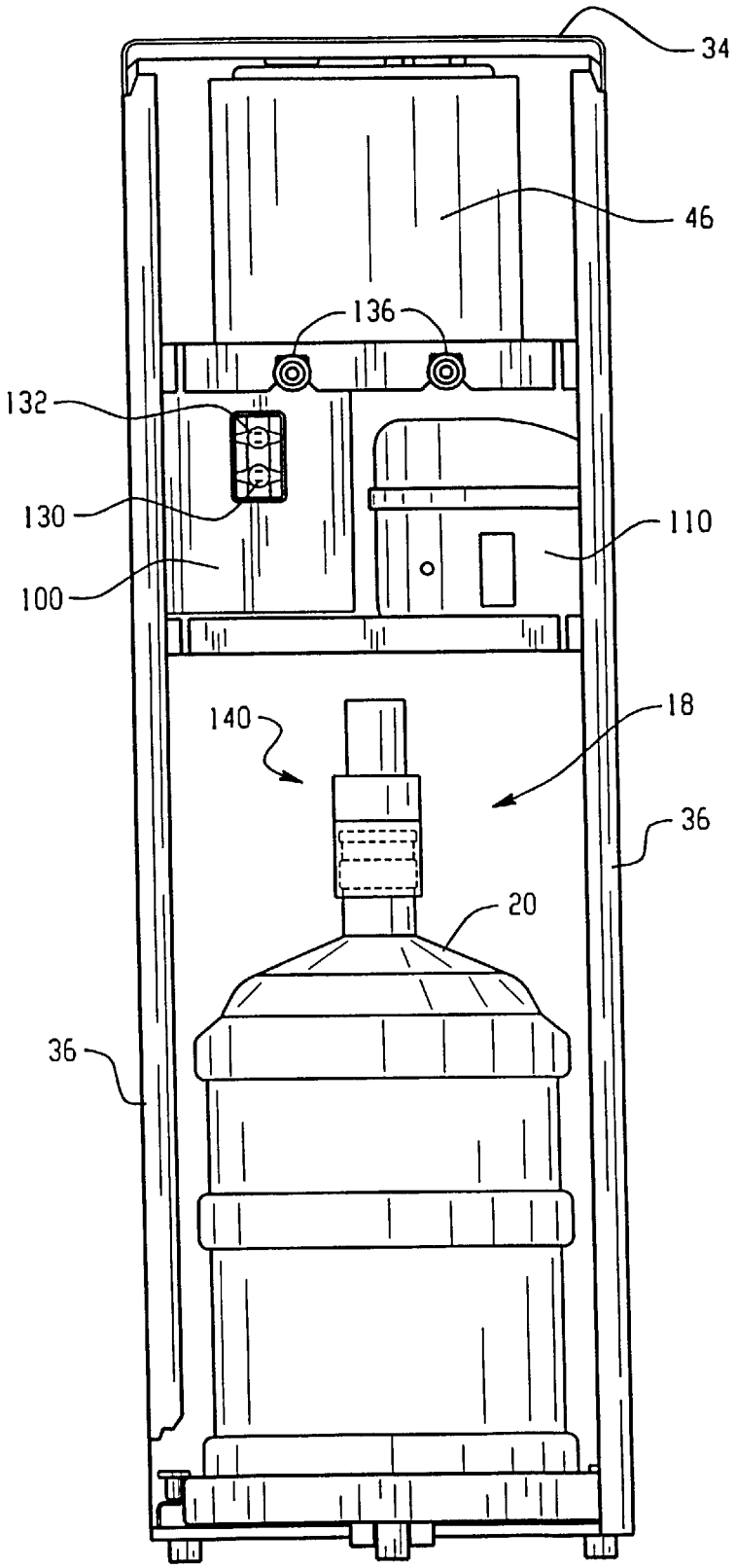
Figure 3C:
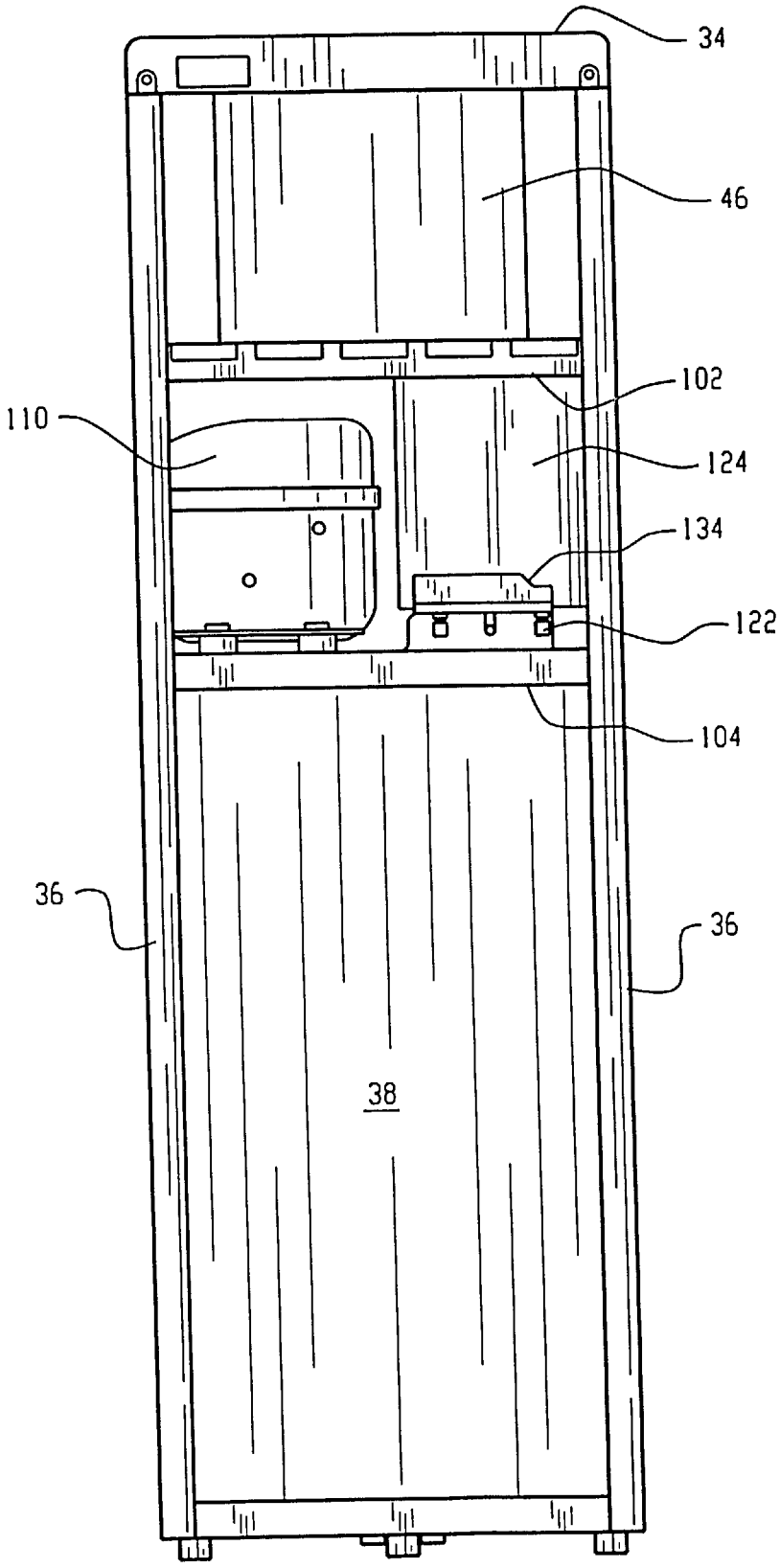
Figure 4B:
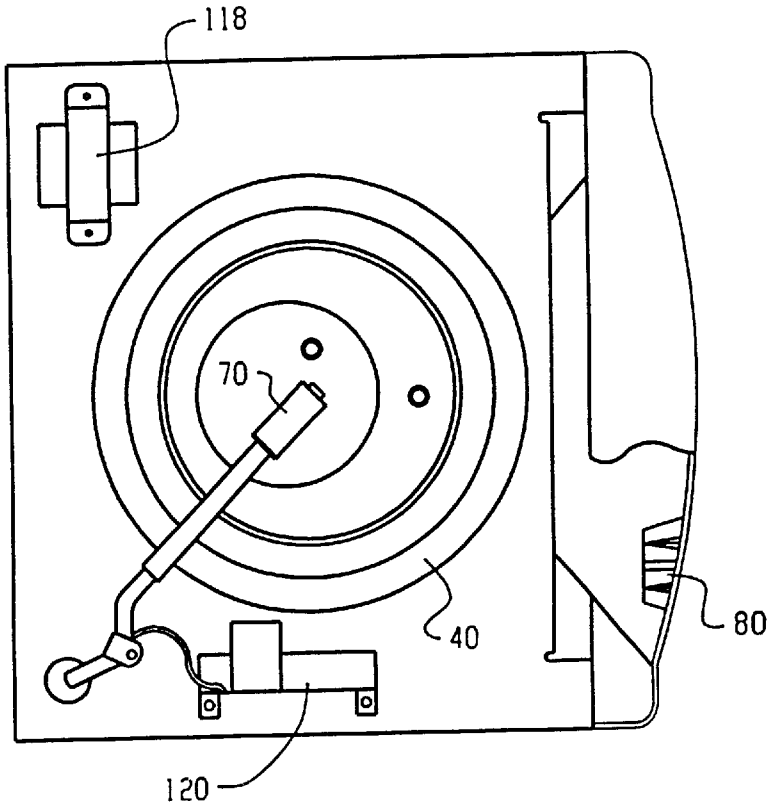
FIGS. 4A and 4B are top sectional views respectively showing various dispensing components.
Figure 4A:
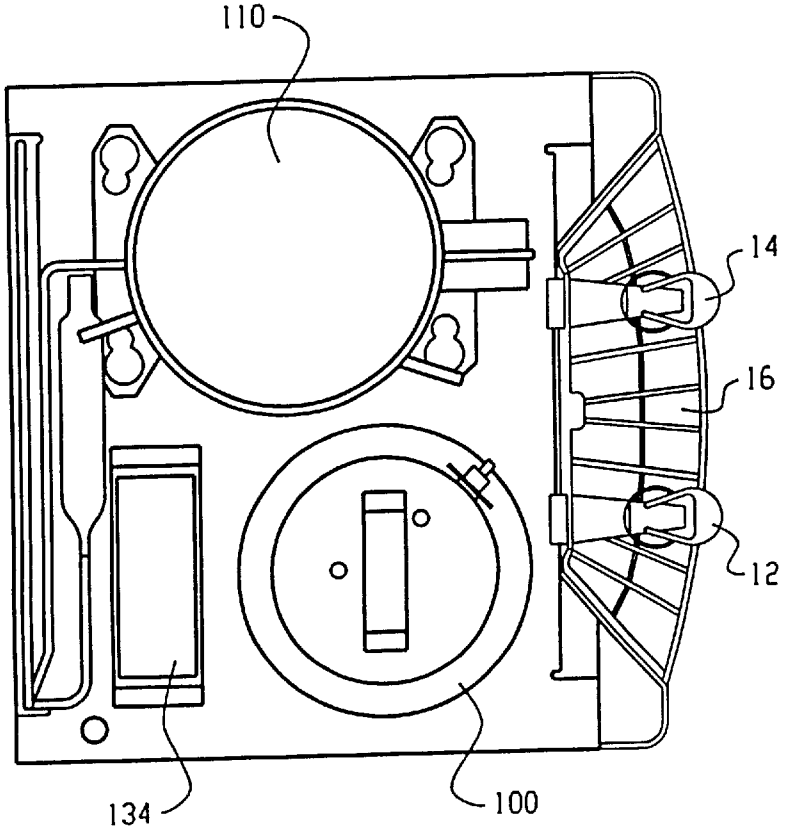
Figure 7:
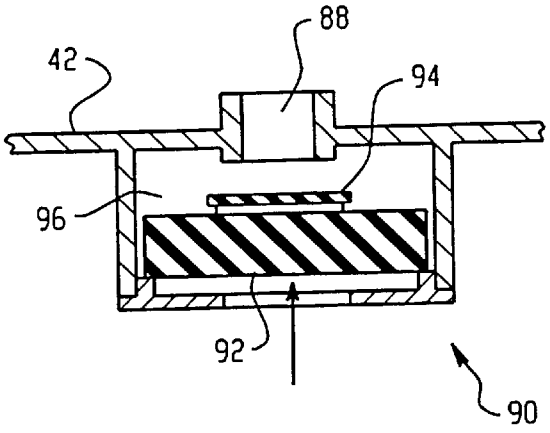
FIG. 7 is a side-sectional view of the present overflow protector assembly.

As shown in FIG. 1, the liquid supply 18 can be boxed water, as will be discussed in detail below. The liquid supply 18 can also be a five-gallon water bottle, as specifically shown in FIGS. 2, 3A and 3B, as will be further discussed below. Alternatively, a six-gallon bottle or other size bottle could be employed. Of course, it will be appreciated that the present invention could be used to dispense other liquids, e.g. carbonated beverages, without departing from the invention.

The cabinet 10 also includes a lower cabinet door 30 that closes to conceal the liquid supply 20. A rolling base 32 is provided to retain and support the liquid supply 20. The rolling base 32 includes a roller or wheel arrangement to allow the base 32 to out from the lower cabinet 18, in order to provide an extended platform for the liquid supply 20, thereby providing ease of installing a new liquid supply 20. The cabinet 10 also includes other external housing components, as shown in FIGS. 1, 3A, 3B and 3C, such as a top lid 34, side panels 36, and a back panel 38.

As indicated in FIGS. 2, 2A, 3B and 3C, the present liquid dispensing includes a reservoir assembly 40 for receiving a flow of liquid from the liquid supply 20. The reservoir assembly 40 includes a lid 42 and a seal washer 44 to provide a fluid-tight chamber for retaining the liquid. A reservoir insulator 46 is an insulating layer provided to help the reservoir 40 maintain a desired dispensing temperature. The reservoir assembly 40 is connected to a faucet 12 for dispensing liquid from the reservoir assembly 40.

A liquid level sensor 50 is provided for initiating the liquid flow from the liquid supply 20 until a predetermined liquid level is established in the reservoir assembly 40. The liquid level sensor 50 preferably includes a switch arrangement for actuating a liquid pump assembly 52 that pumps liquid, so as to generate the liquid flow to the reservoir assembly 40 from the liquid supply 20. However, it should be understood that the liquid level sensor 50 could also be used to control the action of a valve or other means for supplying liquid from an external supply, e.g. a pressurized or gravity-fed liquid supply.

Figure 5B:
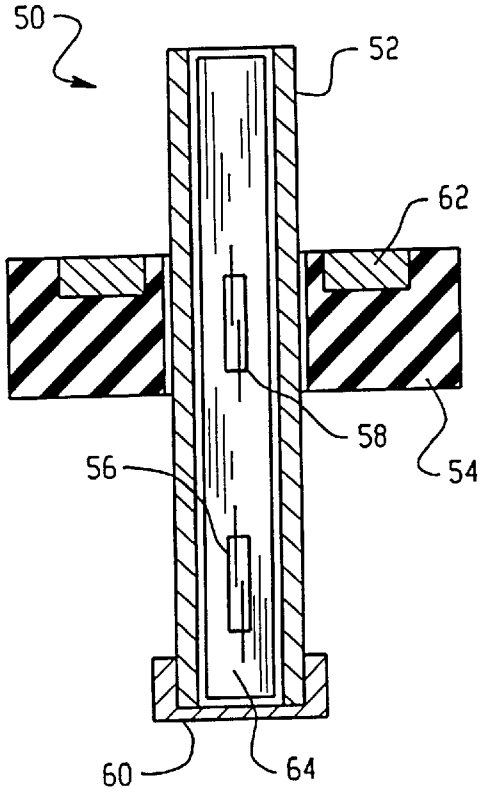
FIGS. 5A and 5B are side sectional views showing the operational positions of the present water level sensor.
Figure 5A:
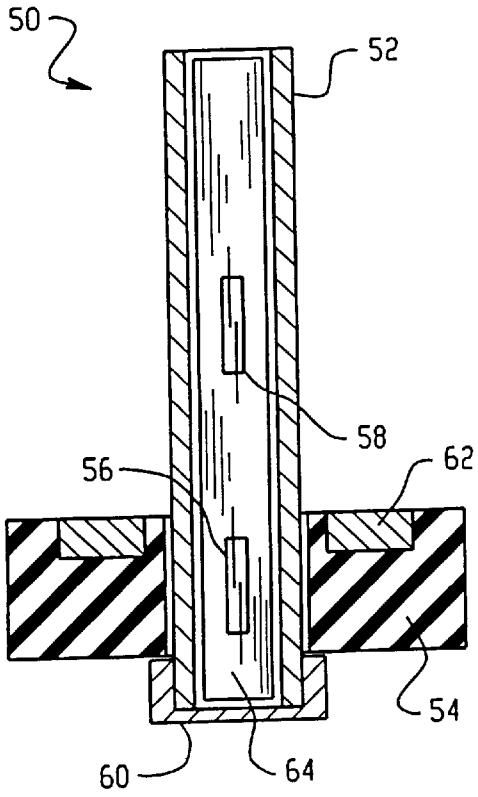

As shown in FIGS. 5A and 5B, the liquid level sensor 50 includes a tube 52 that movably supports a buoy 54 that varies with liquid level between a fill position and a full position. A first switch 56 is supported inside the tube 52 at the fill position and a second switch 58 is supported at the full position. When liquid is dispensed at the faucet 12, the water level drops and the buoy 54 moves down, eventually reaching the fill position, where it contacts a cap 60 that stops its downward motion. At that point, (as shown in FIG. 5A) the buoy 54 activates the first switch 56, which turns on the pump assembly 52 to initiate the liquid flow from the liquid supply 20. The liquid level rises and the buoy 54 rises with it until the full position is reached. At this point, (as shown in FIG. 5B) the second switch 58 is activated, which turns off the pump 52 and discontinues the liquid flow, thereby establishing a predetermined liquid level. In the preferred embodiment, the first and second switches 56, 58 are magnet switches retained inside the tube 52 in a fluid-tight manner. A magnet 62 is incorporated onto the buoy 54 for respectively activating each switch when at each respective position. Of course, it should be understood that a mechanical or other type switch could also be employed without departing from the invention. The tube 52 also encloses a circuit board 64 for processing signals from the first and second switches.

Figure 6A:
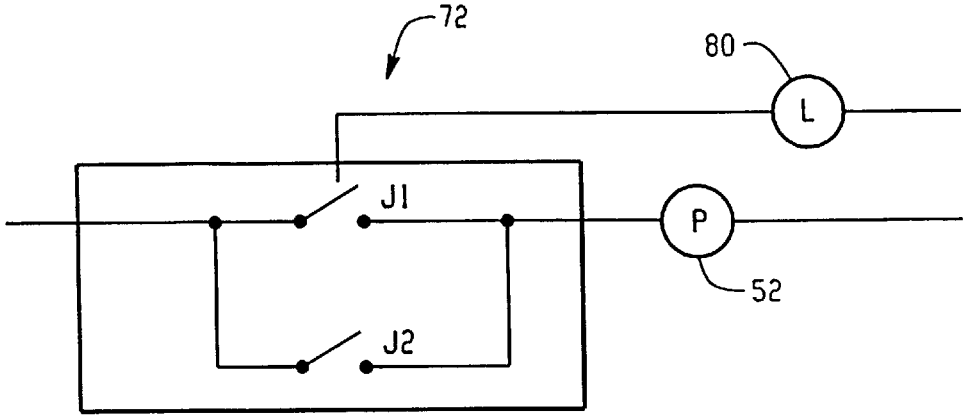
FIGS. 6A and 6B are respectively a circuit diagram and a side-sectional view of the present water flow sensor assembly.
Figure 6B:
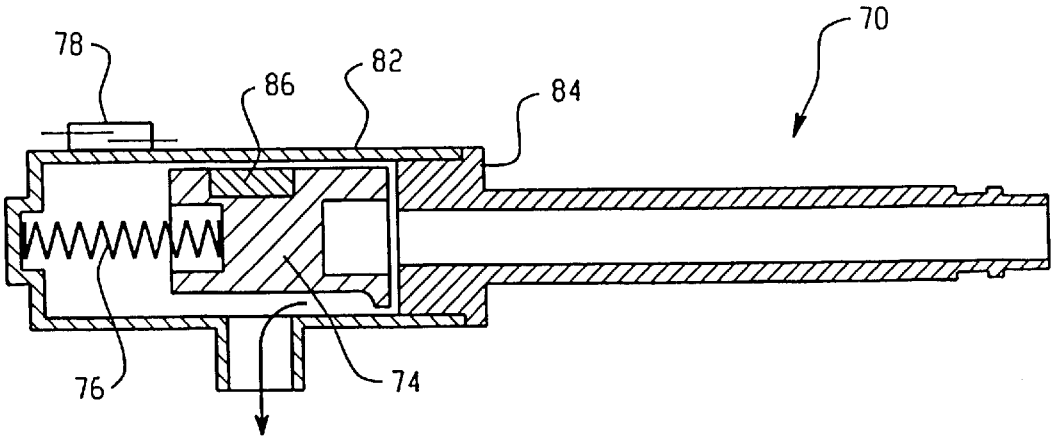

A liquid flow sensor 70 is provided for indicating a flow condition from the liquid supply 20 to the reservoir assembly 40. The liquid flow sensor 70 serves to control the operation of the pump assembly 52 to prevent the liquid supply 20 from running dry, in order to override the control of the liquid level sensor 50 and thereby prevent a "dry pumping" condition. As shown in FIGS. 6A and 6B, the liquid flow sensor 70 cooperates with a control circuit 72. When liquid flow is initiated by the liquid level sensor 50, a first relay J1 in the control circuit 72 is engaged and operates with a delay of between 5–30 seconds, after which it disengages to turn of the pump assembly 52.

As liquid flows through the flow sensor 70 into the reservoir assembly 40, the liquid pressure of the flow acts on a plunger member 74, biased with a spring 76 toward a closed position, thereby displacing the plunger member 74 to an open position in response to the liquid flow. In the open position, the plunger member 74 contacts a switch 78 that activates a second relay J2 in the control circuit 72. Even though the first relay J1 is designed to disengage the pump assembly 52 after a delay of 5–30 seconds, the relay J2 remaining connected while the plunger is in the open position, and maintains pump operation until the reservoir assembly 40 is filled to the predetermined fill position, and the pump assembly 52 is disengaged by the liquid level sensor 50.

However, if the liquid supply 20 should run dry during the operation of the pump assembly 52, the pressure against the plunger member 74 disappears, and a flow condition is no longer indicated. Thus, the spring 76 pushes the plunger member 74 back to the closed position.

This disengages the switch 78, thereby disengaging the relay J2. At such a time thereafter as the delay at relay J1 elapses, the pump assembly 52 is disengaged and an attention indicator 80 is activated, preferably a red light, to indicate that a change of fluid supply is required. In the preferred embodiment, the switch 78 is a magnet switch mounted to the outside of the sensor housing 82, at a position substantially proximate to the open position, displaced from a liquid entrance tube 84. A magnet 86 is mounted on the plunger member 74 so as to activate the magnet switch 78 when in the open position. However, it should be appreciated that any type switch, including mechanical, could be employed without departing from the invention.

A filtered air vent 88 is provided for ventilating the reservoir assembly 40, and thereby allow the liquid to fill and dispense without creating over and under pressure conditions in the reservoir assembly 40. An overflow protector assembly 90 is provided for preventing an overflow condition of liquid from the reservoir assembly 40 out through the air vent 88, in the event of a malfunction that causes liquid to rise above the predetermined fill level. The overflow protector assembly 90 includes a buoy 92 that floats up with the liquid level to block the air vent 88. The buoy 92 includes a rubber stopper 94 for sealing against the air vent 88. Preferably, the buoy 92 is movably retained within a chamber 96, formed integrally with the lid 42 of the reservoir assembly 40. In the event that the pump assembly 52 would continue to run, a back pressure buildup would then occur in the reservoir assembly 40, which would overload the pump. Thus, the pump assembly 52 includes pressure switch 98 so any back pressure created by the overflow protector assembly 90 causes the pressure switch 98 to deactivate the pump assembly 52.

In the preferred embodiment, the reservoir assembly 40 is fluidly connected to an auxiliary tank assembly 100 that cooperates with a second faucet 14 for dispensing liquid from the auxiliary tank assembly 100. In one preferred aspect of the invention, one or both of the reservoir assembly 40 and the auxiliary tank assembly 100 can be either heated or refrigerated, to provide hot or cold liquid. In this way, any combination of liquid temperatures could be dispensed, either hot and cold, hot and room temperature, or cold and room temperature. Alternatively, one or more additional tanks can be provided to dispense liquid at a third or more temperature, or another type of liquid, without departing from the invention.

In the preferred embodiment as illustrated in the figures, the reservoir assembly 40 dispenses cold liquid and the auxiliary tank assembly 100 dispenses hot liquid. As shown particularly in FIGS. 3A, 3B and 3C, the reservoir assembly 40 is supported on an upper panel 102 and the auxiliary tank assembly 100 is supported below on a middle panel 104, above the lower cabinet section 18. The reservoir assembly 40 is refrigerated and includes refrigeration components such as a compressor 110, a vaporizer 112, a condenser 114, and a water separator 116, and preferably operates with HFC-134a refrigerant. A control board 118 and a transformer 100 are provided to support the desired refrigeration functions. The reservoir insulator 46 maintains a desired cold temperature in the reservoir assembly 40.

The auxiliary tank assembly 100 is heated with a heater 122, placed underneath the tank assembly 100. A hot tank insulator 124 surrounds the tank assembly 100 to maintain a desired hot temperature. A thermostat 130 and an overheat protector 132 are provided to allow safe control of the heater 122, and a wire box 134 is used to provide wiring connections for the various components. Spouts 136 are provided to connect the reservoir 40 and tank 100 to the respective faucets 12, 14. The reservoir 40 and tank 100 are preferably made of stainless steel and preferably have capacities of 0.65 gallon (2.5 liter) and 0.40 gallon (1.5 liter).

In the preferred embodiment, a removable connection assembly 140 is provided for connecting to a removable liquid supply 20. As shown in the embodiment of FIGS. 2 and 3A, 3B and 3C, the connection assembly 140 is a bottle cap assembly 142 for connecting the pump assembly 52 to the cap of a removal five-gallon water bottle. An air filter 144 is formed within the bottle cap assembly 142 to maintain equal pressure as the liquid is dispensed from the liquid supply 20. A draw tube 146 is inserted into the water bottle and extends from the bottle cap assembly 142 to the bottom of the water bottle to draw out liquid under the action of the pump assembly 52. In an alternative embodiment shown in FIG. 1, the removable liquid supply 20 is boxed water with a built-in draw tube so as to allow a quick connection and easy disposability when empty. A fluid-tight cap 148 is connected to the pump assembly 52, for fluidly connecting to the built-in draw tube. This fluid-tight cap 148 can be ganged together with other caps 148 connected to other boxed water containers to provide an array 150 of boxed water which can be concealed near the cabinet 10 or kept in an adjoining room or other remote location. In few of the above description, the present invention overcomes the difficulties and drawbacks associated with previous systems.

As described hereinabove, the present invention solves many problems associated with previous type devices. However, it will be appreciated that various changes in the details, materials and arrangements of parts which have been herein described and illustrated in order to explain the nature of the invention may be made by those skilled in the area within the principle and scope of the invention will be expressed in the appended claims.

I Claim:

1. A liquid dispensing system comprising:

a reservoir assembly for receiving a liquid flow from a liquid supply;

a liquid level sensor for initiating the liquid flow until a predetermined liquid level is established in the reservoir assembly;

a liquid flow sensor for indicating a flow condition from the liquid supply to the reservoir assembly;

a dispensing member for dispensing liquid from the reservoir assembly.

2. The liquid dispensing system of claim 1 wherein the liquid level sensor comprises:

a first switch supported at a fill position for initiating the liquid flow when liquid level drops to the fill position;

a second switch supported at a full position corresponding to the predetermined liquid level for discontinuing the liquid flow when liquid level reaches the full position.

3. The liquid dispensing system of claim 2 wherein the liquid level sensor further comprises a buoy that varies with liquid level so as to activate the first switch at the fill position and activate the second switch at the full position.

4. The liquid dispensing system of claim 3 wherein the first and second switches are magnet switches and wherein the buoy includes a magnet for respectively activating each switch when at each respective position.

5. The liquid dispensing system of claim 3 further comprising a tube for movably supporting the buoy.

6. The liquid dispensing system of claim 5 wherein the tube encloses the first and second switches in a fluid-tight manner.

7. The liquid dispensing system of claim 5 wherein the tube encloses a circuit board for processing signals from the first and second switches.

8. The liquid dispensing system of claim 1 wherein the liquid flow is pumped from the liquid supply to the reservoir assembly with a pump assembly.

9. The liquid dispensing system of claim 8 wherein the pump assembly is activated by the liquid level sensor to initiate the liquid flow, wherein the pump assembly is further regulated by a control circuit comprising:

a first relay for disengaging the pump assembly following a predetermined interval;

a second relay for maintaining pump activation following disengagement of the first relay when the liquid flow sensor indicates a flow condition, wherein pump activation is discontinued when both first and second relays are disengaged.

10. The liquid dispensing system of claim 1 further comprising an attention indicator activated when the liquid flow sensor no longer indicates a flow condition.

11. The liquid dispensing system of claim 1 wherein the liquid flow is generated by a pump member and wherein the liquid flow sensor comprises:

a plunger member biased toward a closed position and displaced in an open position in response to the liquid flow;

a switch that cooperates with the plunger member to continue pump member operation when the plunger member is in the open position and to discontinue pump member operation when the plunger member is in the closed position.

12. The liquid dispensing system of claim 11 wherein the switch is a magnet switch mounted on a sensor housing at a position substantially proximate to the open position and wherein the plunger member includes a magnet for engaging the magnet switch in the open position and disengaging the magnet switch when not in the open position.

13. The liquid dispensing system of claim 1 wherein the reservoir assembly is fluidly connected to an auxiliary tank assembly having a second dispensing member for dispensing liquid from the auxiliary tank assembly.

14. The liquid dispensing system of claim 13 wherein at least one of the reservoir assembly and the auxiliary tank assembly is one of heated and refrigerated, to respectively provide one of hot and cold liquid.

15. The liquid dispensing system of claim 1 wherein the reservoir assembly comprises an air vent for ventilating the reservoir assembly.

16. The liquid dispensing system of claim 1 wherein the reservoir assembly comprises an overflow protector assembly for preventing an overflow condition of liquid from the reservoir assembly.

17. The liquid dispensing system of claim 16 wherein the overflow protector assembly comprises a buoy that blocks an air vent in the reservoir assembly to prevent an overflow condition.

18. The liquid dispensing system of claim 17 wherein the buoy is movably retained within a chamber, formed integrally with a lid of the reservoir assembly, and wherein the buoy includes a rubber stopper for sealing against the air vent.

19. The liquid dispensing system of claim 16 wherein the liquid flow is generated by a pump that includes a pressure switch such that a back pressure created by the overflow protector assembly causes the pressure switch to deactivate the pump.

20. The liquid dispensing system of claim 1 further comprising a connection assembly for connecting to a removable liquid supply.

21. The liquid dispensing system of claim 20 wherein the removable liquid supply is a water bottle and the connection assembly is a bottle cap assembly with a draw tube inserted into the water bottle.

22. The liquid dispensing system of claim 20 wherein the removable liquid supply is a boxed liquid with a built-in draw tube and the connection assembly comprises a fluid-tight cap for fluidly connecting to the draw tube.

23. A liquid dispensing system comprising:

a reservoir assembly for receiving a liquid flow from a liquid supply;

a liquid flow sensor for indicating a flow condition from the liquid supply to the reservoir assembly;

a dispensing member for dispensing liquid from the reservoir assembly; and a liquid level sensor for initiating the liquid flow until a predetermined liquid level is established in the reservoir assembly, wherein the liquid level sensor comprises:

a first switch supported at a fill position for initiating the liquid flow when liquid level drops to the fill position;

a second switch supported at a full position corresponding to the predetermined liquid level for discontinuing the liquid flow when liquid level reaches the full position.

24. A liquid dispensing system comprising:

a pump member for generating a liquid flow from a liquid supply;

a reservoir assembly for receiving the liquid flow;

a liquid level sensor for initiating the liquid flow until a predetermined liquid level is established in the reservoir assembly;

a dispensing member for dispensing liquid from the reservoir assembly;

a liquid flow sensor for indicating a flow condition from the liquid supply to the reservoir assembly, wherein the liquid flow sensor comprises:

a plunger member biased toward a closed position and displaced in an open position in response to the liquid flow;

a switch that cooperates with the plunger member to continue pump member operation when the plunger member is in the open position and to discontinue pump member operation when the plunger member is in the closed position.

25. A liquid dispensing system comprising:

a reservoir assembly for receiving a liquid flow from a liquid supply, wherein the reservoir assembly comprises an overflow protector assembly having a buoy that blocks an air vent in the reservoir assembly, for preventing an overflow condition of liquid from the reservoir assembly;

a liquid level sensor for initiating the liquid flow until a predetermined liquid level is established in the reservoir assembly;

a liquid flow sensor for indicating a flow condition from the liquid supply to the reservoir assembly;

a dispensing member for dispensing liquid from the reservoir assembly.

* * * * *